US007390605B2

(12) United States Patent
Shirai

(10) Patent No.: US 7,390,605 B2
(45) Date of Patent: Jun. 24, 2008

(54) RESIN BINDER FOR TONER

(75) Inventor: Eiji Shirai, Wakayama (JP)

(73) Assignee: Kao Corporation, Tokyo (JP)

( * ) Notice: Subject to any disclaimer, the term of this patent is extended or adjusted under 35 U.S.C. 154(b) by 288 days.

(21) Appl. No.: 11/095,593

(22) Filed: Apr. 1, 2005

(65) Prior Publication Data

US 2005/0227157 A1 Oct. 13, 2005

(30) Foreign Application Priority Data

Apr. 9, 2004 (JP) ..... 2004-116056

(51) Int. Cl.
*G03G 9/00* (2006.01)

(52) U.S. Cl. ..... 430/109.4; 522/104

(58) Field of Classification Search ..... 430/109.4; 522/104

See application file for complete search history.

(56) References Cited

U.S. PATENT DOCUMENTS

| | | | | |
|---|---|---|---|---|
| 2003/0096184 | A1* | 5/2003 | Kawaji et al. | 430/109.3 |
| 2003/0129518 | A1* | 7/2003 | Sawada et al. | 430/109.4 |
| 2004/0023141 | A1* | 2/2004 | Shirai et al. | 430/109.3 |
| 2004/0185355 | A1* | 9/2004 | Sato et al. | 430/45 |
| 2005/0227157 | A1 | 10/2005 | Shirai | |

OTHER PUBLICATIONS

US. Appl No. 11/578,292, filed Oct. 13, 2006, Shirai.
Patent Abstracts of Japan, JP 4-239021A, Aug. 26, 1992.
Patent Abstracts of Japan, JP 8-036274A, Feb. 6, 1996.
Patent Abstracts of Japan, JP 2003-176339A, Jun. 24, 2003.
Patent Abstracts of Japan, JP 56-065146A, Jun 2, 1981.
Patent Abstracts of Japan, JP 2001-222138A, Aug. 17, 2001.
Patent Abstracts of Japan, JP 2002-287426A, Oct. 3, 2002.
Patent Abstracts of Japan, JP 2003-173047A, Jun. 20, 2003.
US. Appl. No. 11/095,595, filed Apr. 1, 2005, Shirai et al..
US. Appl. No. 11/095,593, filed Apr. 1, 2005, Shirai.
US. Appl. No. 11/010,261, filed Dec. 12, 2004, Shirai et al.

* cited by examiner

*Primary Examiner*—Mark F. Huff
*Assistant Examiner*—Peter L Vajda
(74) *Attorney, Agent, or Firm*—Oblon, Spivak, McClelland, Maier & Neustadt, P.C.

(57) ABSTRACT

The present invention relates to a resin binder for toner, containing a crystalline polyester having a softening point of 80° to 130° C., containing a resin obtained by polycondensation of an alcohol component comprising 70% by mol or more of an aliphatic diol having 2 to 8 carbon atoms, and a carboxylic acid component comprising 70% by mol or more of an aromatic dicarboxylic acid compound; and an amorphous polyester-based resin containing a resin containing a polyester component obtained by polycondensation of an alcohol component comprising 70% by mol or more of an alkylene oxide adduct of bisphenol A, represented by the formula (I):

(I)

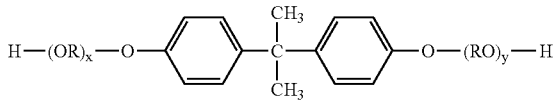

wherein R is an alkylene group having 2 or 3 carbon atoms; x and y are a positive number; and the sum of x and y is from 1 to 16, and a carboxylic acid component, wherein the weight ratio of the crystalline polyester to the amorphous polyester-based resin is from 5/95 to 50/50. The resin binder for toner of the present invention is used as a resin binder for a toner used, for instance, for developing electrostatic latent images formed in electrophotography, electrostatic recording method, electrostatic printing, and the like.

18 Claims, No Drawings

RESIN BINDER FOR TONER

FIELD OF THE INVENTION

The present invention relates to a resin binder for a toner used, for instance, for developing electrostatic latent images formed in electrophotography, electrostatic recording method, electrostatic printing method, and the like, and a toner containing the resin binder.

BACKGROUND OF THE INVENTION

In response to requests for higher speed, smaller size and the like in printing machines in recent years, resin binders for toner which can be fixed at lower temperature have been desired. In view of this, there have been reported a crystalline polyester prepared by using an aromatic terephthalic acid (JP-A-Hei-4-239021 and JP-A-Hei-8-36274), and a crystalline polyester prepared by using an aliphatic adipic acid (JP2003-176339 A). In addition, from the viewpoint of improving offset resistance, which is a technical problem to be solved with crystalline resins, there is known a technique of using a crystalline polyester in combination with an amorphous polyester and the like (JP-A-Showa-56-65146, JP2001-222138 A, JP2002-287426 A and JP2003-173047 A).

SUMMARY OF THE INVENTION

The present invention relates to a resin binder for toner, containing:

a crystalline polyester having a softening point of 80° to 130° C., containing a resin obtained by polycondensation of an alcohol component containing 70% by mol or more of an aliphatic diol having 2 to 8 carbon atoms, and a carboxylic acid component containing 70% by mol or more of an aromatic dicarboxylic acid compound; and an amorphous polyester-based resin, containing a resin containing a polyester component obtained by polycondensation of an alcohol component containing 70% by mol or more of an alkylene oxide adduct of bisphenol A, represented by the formula (I):

(I)

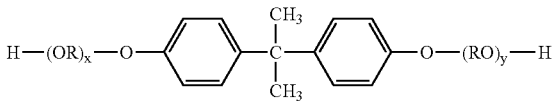

wherein R is an alkylene group having 2 or 3 carbon atoms; x and y are a positive number; and the sum of x and y is from 1 to 16, and a carboxylic acid component, wherein the weight ratio of the crystalline polyester to the amorphous polyester-based resin is from 5/95 to 50/50, and to a toner containing the resin binder.

DETAILED DESCRIPTION OF THE INVENTION

Conventionally known aromatic crystalline polyesters have too high a melting point or insufficient crystallinity, so that excellent low-temperature fixing ability is not obtained. Also, in the case of aliphatic crystalline polyesters, the environmental stability, particularly the triboelectric stability under environmental conditions at high temperature and humidity, is insufficient. In addition, when a crystalline polyester is used in combination with an amorphous resin, the blocking resistance is likely to be lowered. Therefore, there has been desired a resin binder for toner which concurrently satisfies all of the above-mentioned properties.

The present invention relates to a resin binder for toner, which is excellent in all of low-temperature fixing ability, environmental stability and blocking resistance, and to a toner containing the resin binder.

The resin binder for toner of the present invention and the toner containing the resin binder exhibit an effect of being excellent in all of low-temperature fixing ability, environmental stability and blocking resistance.

These and other objects of the present invention will be apparent from the following description.

The resin binder for toner of the present invention contains a crystalline polyester and an amorphous polyester-based resin each having a specified monomer composition. Crystalline polyesters exhibit an excellent low-temperature fixing ability, as compared to amorphous polyester, but the triboelectric chargeability is likely to be unstable at high temperature and humidity. Also, when a crystalline polyester is used in combination with an amorphous resin, the blocking resistance tends to be lowered. In the present invention, however, by combining the crystalline polyester and the amorphous polyester-based resin each containing specified raw material monomers described below, satisfactory levels are achieved in low-temperature fixing ability as well as environmental stability and blocking resistance.

In the present invention, the "crystalline resin" refers to a resin having a ratio of the softening point to the temperature of maximum endothermic peak (softening point/temperature of maximum endothermic peak) is from 0.6 to 1.3, preferably from 0.9 to 1.2, more preferably more than 1 and 1.2 or less. Also, the "amorphous resin" refers to a resin having a ratio of the softening point to the temperature of maximum endothermic peak (softening point/temperature of maximum endothermic peak) is more than 1.3 and 4 or less, preferably from 1.5 to 3. The ratio of the softening point to the temperature of maximum endothermic peak is adjusted by the kind and proportion of the raw material monomers, the molecular weight, manufacturing conditions (for example, cooling rate), and the like.

The crystalline polyester in the present invention is a resin obtained by polycondensation of an alcohol component containing an aliphatic diol having 2 to 8 carbon atoms, and a carboxylic acid component containing an aromatic dicarboxylic acid compound.

The aliphatic diol having 2 to 8 carbon atoms includes ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, 1,4-butenediol, and the like. Especially, an α,ω-linear alkane diol is preferable, 1,4-butanediol and 1,6-hexanediol are more preferable, and 1,4-butanediol is even more preferable.

The aliphatic diol having 2 to 8 carbon atoms is contained in the alcohol component in an amount of 70% by mol or more, preferably from 80 to 100% by mol, more preferably from 90 to 100% by mol, from the viewpoint of increasing the crystallinity. Especially, it is desirable that one of the aliphatic diols comprises 70% by mol or more, preferably from 80 to 95% by mol of the alcohol component. In particular, it is desirable that 1,4-butenediol is contained in the alcohol component in an amount of preferably 60% by mol or more, more preferably from 70 to 100% by mol, even more preferably from 80 to 100% by mol.

A polyhydric alcohol component other than the aliphatic diol having 2 to 8 carbon atoms, which may be contained in the alcohol component, includes an aromatic diol such as an alkylene oxide adduct of bisphenol A, represented by the formula (I):

(I)

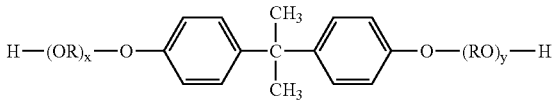

wherein R is an alkylene group having 2 or 3 carbon atoms; x and y are a positive number; and the sum of x and y is from 1 to 16, preferably from 1.5 to 5, for example, polyoxypropylene(2.2)-2,2-bis(4-hydroxyphenyl)propane and polyoxyethylene(2.2)-2,2-bis(4-hydroxyphenyl)propane, and trihydric or higher polyhydric alcohols such as glycerol, pentaerythritol and trimethylolpropane.

The aromatic dicarboxylic acid compound is preferably a compound having a benzene ring, such as phthalic acid, isophthalic acid, terephthalic acid, an acid anhydride thereof or an alkyl(1 to 3 carbon atoms) ester thereof, among which isophthalic acid is more preferable. Here, the aromatic dicarboxylic acid compound refers to the above-mentioned aromatic dicarboxylic acids, acid anhydrides thereof and alkyl(1 to 3 carbon atoms) esters thereof, among which aromatic dicarboxylic acids are preferable.

The aromatic dicarboxylic acid compound is contained in the carboxylic acid component in an amount of 70% by mol or more, preferably from 75 to 100% by mol, more preferably from 80 to 100% by mol.

In the present invention, since the aromatic dicarboxylic acid compound is used as the carboxylic acid component for the crystalline polyester, the triboelectric stability is improved. Moreover, surprisingly, the aromatic dicarboxylic acid compound also exerts a particularly marked effect on the low-temperature fixing ability, as compared with a crystalline polyester having a similar softening point, in which an aliphatic dicarboxylic acid compound is used as a major component of the carboxylic acid component.

A polycarboxylic acid compound other than the aromatic dicarboxylic acid compound, which may be contained in the carboxylic acid component, includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid and n-dodecenylsuccinic acid; alicyclic dicarboxylic acids such as cyclohexanedicarboxylic acid; tricarboxylic or higher polycarboxylic acids such as trimellitic acid and pyromellitic acid; acid anhydrides thereof; alkyl(1 to 3 carbon atoms) esters thereof; and the like.

Further, the alcohol component and/or the carboxylic acid component may appropriately contain a monohydric alcohol or a monocarboxylic acid compound, from the viewpoint of adjusting the molecular weight, and the like, within a range which does not impair the effects of the present invention.

With respect to the molar ratio of the carboxylic acid component to the alcohol component (carboxylic acid component/alcohol component) in the crystalline polyester, it is preferable that the alcohol component is used more than the carboxylic acid component when increase in the molecular weight of the crystalline polyester is intended. Further, the molar ratio is preferably 0.9 or more and less than 1, more preferably 0.95 or more and less than 1, from the viewpoint of easily adjusting the molecular weight of the polyester by distilling the alcohol component off during the reaction under vacuum.

The crystalline polyester in the present invention is obtained by polycondensation of the above-mentioned alcohol component with carboxylic acid component, for instance, at a temperature of from 120° to 230° C. in an inert gas atmosphere, using an esterification catalyst, a polymerization inhibitor and the like as occasion demands. Concretely, in order to enhance the strength of the resin, the entire monomers may be charged at once. Alternatively, in order to reduce the low-molecular weight components, divalent monomers may be firstly reacted, and thereafter trivalent or higher polyvalent monomers may be added and reacted. In addition, the reaction may be promoted by reducing the pressure of the reaction system in the second half of the polymerization.

In the present invention, the crystalline polyester has a number-average molecular weight of preferably 2000 or more, more preferably 4000 or more, from the viewpoint of storage property and durability of the toner. However, taking the productivity of the crystalline polyester into consideration, the number-average molecular weight is preferably 10000 or less, more preferably 9000 or less, even more preferably 8000 or less.

Also, the weight-average molecular weight of the crystalline polyester is preferably 9000 or more, more preferably 20000 or more, even more preferably 60000 or more, and preferably 10000000 or less, more preferably 6000000 or less, even more preferably 4000000 or less, even more preferably 1000000 or less, from the same viewpoint as in the number-average molecular weight.

Here, in the present invention, each of the number-average molecular weight and the weight-average molecular weight of the crystalline polyester refers to a value obtained by determining chloroform-soluble components.

In order to obtain such crystalline polyesters having an increased molecular weight, the reaction conditions may be selected, for instance, the molar ratio between the carboxylic acid component and the alcohol component is adjusted, as described above; the reaction temperature is raised; the amount of a catalyst is increased; and the dehydration reaction is carried out under reduced pressure for a longer time. Incidentally, although crystalline polyesters having an increased molecular weight can be obtained by using a high-power motor, when a crystalline polyester having an increased molecular weight is prepared without any particular selection of manufacturing equipment, it may be an effective means to react the raw material monomers with a non-reactive resin having a low viscosity or a non-reactive solvent.

The crystalline polyester has a softening point of from 80° to 130° C., preferably from 85° to 125° C., more preferably from 90° to 115° C., from the viewpoint of low-temperature fixing ability.

On the other hand, the amorphous polyester-based resin in the present invention is a resin containing a polyester component obtained by polycondensation of an alcohol component containing 70% by mol or more of an alkylene oxide adduct of bisphenol A, represented by the above-mentioned formula (I), and a carboxylic acid component.

The above-mentioned alkylene oxide adduct of bisphenol A is contained in the alcohol component in an amount of 70% by mol or more, preferably from 80 to 100% by mol, more preferably from 90 to 100% by mol. In the present invention, the alkylene oxide adduct of bisphenol A exerts a surprising effect not only that the environmental stability is improved, but also that the blocking resistance is improved under a certain amount of pressure, though the reason for this is not clear.

An alcohol other than the alkylene oxide adduct of bisphenol A, which may be contained in the alcohol component, can be exemplified by the same alcohols as those used for the crystalline polyester.

It is preferable that the carboxylic acid component contains an aromatic dicarboxylic acid compound, as in the crystalline polyester. The aromatic dicarboxylic acid compound is contained in the carboxylic acid component in an amount of preferably 70% by mol or more, more preferably from 80 to 100% by mol, even more preferably from 90 to 100% by mol.

A carboxylic acid compound other than the aromatic dicarboxylic acid compound, which may be contained in the carboxylic acid component, can be exemplified by the same carboxylic acid compounds as those used for the crystalline polyester.

The amorphous polyester in the present invention is obtained by polycondensation of the alcohol component with the carboxylic acid component, for instance, at a temperature of from 150° to 280° C., preferably from 200° to 250° C. in an inert gas atmosphere, in the presence of an esterification catalyst if necessary.

In the present invention, the amorphous polyester-based resins containing a polyester component obtained by polycondensation of the above-mentioned alcohol component with carboxylic acid component, include not only polyesters but also modified resins of polyesters.

The modified resins of polyesters include, for instance, urethane-modified polyesters in which a polyester is modified by an urethane bond, epoxy-modified polyesters in which a polyester is modified by an epoxy bond, hybrid resins containing two or more resin components including a polyester component, and the like.

As the amorphous polyester-based resin, either one of the polyester and the modified polyester resin may be used, or both may be used in combination. In the present invention, preferable is a polyester and/or a hybrid resin containing a polyester component and a vinyl resin component.

The hybrid resin containing a polyester component and a vinyl resin component may be prepared by any method, for example, a method including melt-kneading both resin components in the presence of an initiator and the like if necessary; a method including dissolving the resin components separately in a solvent, and mixing the resulting two solutions; and a method including polymerizing a mixture of the raw material monomers for both resin components. Preferable is a resin obtained by a condensation polymerization reaction and an addition polymerization reaction using raw material monomers for the polyester and raw material monomers for the vinyl resin (JP-A-Hei-7-98518).

The raw material monomer for the vinyl resin includes styrenic compounds such as styrene and α-methylstyrene; ethylenically unsaturated monoolefins such as ethylene and propylene; diolefins such as butadiene; vinyl halides such as vinyl chloride; vinyl esters such as vinyl acetate and vinyl propionate; esters of ethylenic monocarboxylic acids such as alkyl(1 to 18 carbon atoms) esters of (meth)acrylic acid and dimethylaminoethyl (meth)acrylate; vinyl ethers such as vinyl methyl ether; vinylidene halides such as vinylidene chloride; N-vinyl compounds such as N-vinylpyrrolidone; and the like. Styrene, butyl acrylate, 2-ethylhexyl acrylate and methyl methacrylate are preferable from the viewpoint of reactivity, pulverizability and triboelectric stability. It is more preferable that styrene and/or an alkyl ester of (meth)acrylic acid is contained in an amount of 50% by weight or more, preferably from 80 to 100% by weight of the raw material monomers for the vinyl resin.

When the raw material monomers for the vinyl resin are polymerized, a polymerization initiator, a crosslinking agent, or the like may be used, if necessary.

The weight ratio of the raw material monomers for the polyester to the raw material monomers for the vinyl resin (raw material monomers for polyester/raw material monomers for vinyl resin) is preferably from 55/45 to 95/5, more preferably from 60/40 to 95/5, even more preferably from 70/30 to 90/10, from the viewpoint of forming the continuous phase by the polyester.

In the present invention, it is preferable that the hybrid resin has as a constituent unit a monomer capable of reacting with both of the raw material monomers for the polyester and the raw material monomers for the vinyl resin (hereinafter referred to as dually reactive monomer). Therefore, in the present invention, it is preferable that the condensation polymerization reaction and the addition polymerization reaction are carried out in the presence of the dually reactive monomer, and thus the polyester components and the vinyl resin components are partially bonded via the dually reactive monomers, so that a resin in which the vinyl resin components are more finely and uniformly dispersed in the polyester components can be obtained.

It is preferable that the dually reactive monomer is a monomer having in its molecule at least one functional group selected from the group consisting of hydroxyl group, carboxyl group, epoxy group, a primary amino group and a secondary amino group, preferably a hydroxyl group and/or a carboxyl group, more preferably a carboxyl group and an ethylenically unsaturated bond. Concrete examples of the dually reactive monomer include, for instance, acrylic acid, methacrylic acid, fumaric acid, maleic acid, and the like. Further, the dually reactive monomer may be hydroxyalkyl(1 to 3 carbon atoms) esters of these acids, and acrylic acid, methacrylic acid and fumaric acid are preferable from the viewpoint of reactivity.

In the present invention, among the dually reactive monomers, monomers having two or more functional groups (such as polycarboxylic acid), and derivatives thereof, are considered to be a raw material monomer for the polyester, while monomers having one functional group (such as monocarboxylic acid), and derivatives thereof, are considered to be a raw material monomer for the vinyl resin. The amount of the dually reactive monomer used is preferably from 1 to 10% by mol, more preferably from 4 to 8% by mol, of the raw material monomers for the polyester in the case of the monomers having two or more functional groups and derivatives thereof, or of the raw material monomers for the vinyl resin in the case of the monomers having one functional group and derivatives thereof.

In the present invention, it is preferable that the condensation polymerization reaction and the addition polymerization reaction are carried out in the same reactor. In addition, these polymerization reactions do not necessarily progress or terminate simultaneously, and each of the reactions may be progressed or terminated by appropriately selecting the reaction temperature and reaction time depending on the reaction mechanism.

Concretely, a preferable method includes the steps of (A) carrying out an addition polymerization reaction concurrently with a condensation polymerization reaction under temperature conditions suitable for the addition polymerization reaction, (B) keeping the reaction temperature to the above-mentioned conditions to complete the addition polymerization reaction and then (C) raising the reaction temperature to allow the condensation polymerization reaction to further proceed.

In the step (A), it is preferable that the reaction is carried out by adding dropwise a mixture containing the raw material monomers for the vinyl resin to a mixture containing the raw material monomers for the polyester.

Here, the temperature suitable for the addition polymerization reaction are in the range preferably from 50° to 180° C., though the temperature conditions depend on the kind of the polymerization initiator used. In addition, the temperature range when the temperature is raised to allow the condensation polymerization reaction to further proceed is preferably from 190° to 270° C. By this method of allowing two independent reactions to proceed concurrently in a reactor, a resin binder in which two resins are effectively mixed and dispersed can be obtained.

The amorphous polyester-based resin has a softening point of preferably from 70° to 180° C., more preferably from 100° to 160° C., and a glass transition temperature of preferably from 45° to 80° C., more preferably from 55° to 75° C. Incidentally, glass transition temperature is a property intrinsically owned by an amorphous resin, and is distinguished from the temperature of maximum endothermic peak.

The amorphous polyester-based resin has a number-average molecular weight of preferably from 1000 to 6000, more preferably from 2000 to 5000. Also, the amorphous polyester-based resin has a weight-average molecular weight of preferably 10000 or more, more preferably 30000 or more, and preferably 1000000 or less. In the present invention, each of the number-average molecular weight and the weight-average molecular weight of the amorphous polyester-based resin refers to a value obtained by determining tetrahydrofuran-soluble components.

It is preferable that the amorphous polyester-based resin is comprised of two different kinds of resins of which softening points differ by preferably 10° C. or more, more preferably 20° to 60° C., from the viewpoint of achieving satisfactory levels in both low-temperature fixing ability and offset resistance. The lower-softening point resin has a softening point of preferably from 80° to 120° C., more preferably from 85° to 110° C., from the viewpoint of low-temperature fixing ability. The higher-softening point resin has a softening point of preferably from 120° to 160° C., more preferably from 130° to 155° C., from the viewpoint of offset resistance. The weight ratio of the higher-softening point resin to the lower-softening point resin (higher-softening point resin/lower-softening point resin) is preferably from 20/80 to 80/20, more preferably from 40/60 to 60/40. Incidentally, in the case where the amorphous polyester-based resin is comprised of two or more resins, as described above, it is preferable that the total content of one raw material monomer for the amorphous resin is within the above-mentioned ranges.

The weight ratio of the crystalline polyester to the amorphous polyester-based resin (crystalline polyester/amorphous polyester-based resin) is from 5/95 to 50/50, preferably from 5/95 to 40/60, more preferably from 10/90 to 30/70, from the viewpoint of low-temperature fixing ability, offset resistance and blocking resistance.

Further, in the present invention, a toner containing the above-mentioned resin binder for toner is provided.

The resin binder in the toner of the present invention may contain a resin other than the resin binder for toner of the present invention. The content of the resin binder of the present invention is preferably 80% by weight or more, more preferably 90% by weight or more, of the total amount of the resin binders. The resin which may be used in combination with the resin binder of the present invention includes polyesters other than those in the present invention, vinyl resins, epoxy resins, polycarbonate, polyurethane and the like.

Further, the toner of the present invention may appropriately contain an additive such as a colorant, a releasing agent, a charge control agent, a magnetic powder, an electric conductivity modifier, an extender, a reinforcing filler such as a fibrous substance, an antioxidant, an anti-aging agent, a fluidity improver, or a cleanability improver.

As the colorant, all of the dyes and pigments which are used as colorants for a toner can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow and the like. These colorants can be used alone or in admixture of two or more kinds. The toner of the present invention can be any of black toners, color toners, and full color toners. The content of the colorant is preferably from 1 to 40 parts by weight, more preferably from 3 to 10 parts by weight, based on 100 parts by weight of the resin binder.

The releasing agent includes aliphatic hydrocarbon-based waxes such as low-molecular weight polypropylene, low-molecular weight polyethylene, low-molecular weight polypropylene-polyethylene copolymer, microcrystalline wax, paraffin wax and Fischer-Tropsch wax, and oxidized waxes thereof; ester waxes such as carnauba wax, montan wax and Sazole wax, and deoxidized waxes thereof; fatty acid amides; fatty acids; higher alcohols; fatty acid metal salts; and the like. Among them, aliphatic hydrocarbon-based waxes are preferable from the viewpoint of releasing property and stability.

The melting point of the releasing agent is preferably from 60° to 120° C., more preferably from 100° to 120° C., from the viewpoint of offset resistance and durability.

The content of the releasing agent is preferably from 0.5 to 10 parts by weight, more preferably from 1 to 5 parts by weight, based on 100 parts by weight of the resin binder.

The charge control agent includes positively chargeable charge control agents such as Nigrosine dyes, triphenylmethane-based dyes containing a tertiary amine as a side chain, quaternary ammonium salt compounds, polyamine resins and imidazole derivatives, and negatively chargeable charge control agents such as metal-containing azo dyes, copper phthalocyanine dyes, metal complexes of alkyl derivatives of salicylic acid and boron complexes of benzilic acid.

The content of the charge control agent is preferably from 0.1 to 5 parts by weight, more preferably from 0.5 to 2 parts by weight, based on 100 parts by weight of the resin binder.

The magnetic powder includes ferromagnetic materials such as cobalt, iron and nickel; alloys made of a metal such as cobalt, iron, nickel, aluminum, lead, magnesium, zinc and manganese; metal oxides such as $Fe_3O_4$, $\gamma$-$Fe_3O_4$ and cobalt-containing iron oxide; ferrites such as Mn—Zn ferrite and Ni—Zn ferrite; magnetite, hematite; and the like. Further, the surface of these magnetic powders may be treated with an agent for surface treatment, such as a silane coupling agent or a titanate & silane coupling agent, or may be subjected to polymer coatings.

The primary particle size of the magnetic power is preferably from 0.05 to 0.5 μm, more preferably from 0.1 to 0.3 μm, from the viewpoint of dispersibility.

In the case of magnetic toners, the content of the magnetic powder in the toner is preferably 30% by weight or more, more preferably from 30 to 60% by weight. The magnetic powder may be contained as a black colorant. Although the effects of the present invention can be exhibited in nonmagnetic toners, the present invention is more suitable for magnetic toners because it is difficult to achieve satisfactory levels in both triboelectric chargeability and fixing ability in magnetic toners containing a large amount of magnetic powder which does not contribute to these properties.

The process for preparing the toner may be any of conventionally known methods such as a kneading and pulverization method, a phase-inversion and emulsification method, an emulsification and dispersion method and a suspension polymerization method, using the resin binder of the present invention as one of the raw materials. The kneading and pulverization method is preferable because the preparation of the toner is easy. For instance, in the case of a pulverized toner obtained by the kneading and pulverization method, the toner is prepared by homogeneously mixing a resin binder, a colorant and the like in a mixer such as a Henschel mixer, thereafter melt-kneading the mixture with a closed kneader, a single-screw or twin-screw extruder, or the like, cooling, pulverizing and classifying the product. The weight-average particle size ($D_4$) of the toner is preferably from 3 to 15 μm, more preferably from 4 to 8 μm.

The toner containing the resin binder obtained according to the present invention can be used as a toner for monocomponent development as well as a toner for two-component development. The effects of the present invention are more markedly exhibited when used as a toner for monocomponent development, particularly a toner for magnetic monocomponent development, which is difficult to adjust the triboelectric charges, as compared with a toner for two-component development in which the triboelectric charges are adjusted by a carrier.

EXAMPLES

The following examples further describe and demonstrate embodiments of the present invention. The examples are given solely for the purposes of illustration and are not to be construed as limitations of the present invention.

[Softening Point of Resin]

Softening point refers to a temperature corresponding to ½ of the height (h) of the S-shaped curve showing the relationship between the downward movement of a plunger (flow length) and temperature, namely, a temperature at which a half of the resin flows out, when measured by using a flow tester of the "koka" type ("CFT-500D," commercially available from Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Temperature of Maximum Endothermic Peak and Glass Transition Temperature of Resin and Melting Point of Releasing Agent]

The temperature of maximum endothermic peak is determined with a sample using a differential scanning calorimeter (DSC 210, commercially available from Seiko Instruments, Inc.), when the sample is treated by raising its temperature to 200° C., cooling the sample at a cooling rate of 10° C./min. to 0° C., and thereafter heating the sample so as to raise the temperature at a rate of 10° C./min. The temperature of an intersection of the extension of the baseline of not more than the maximum peak temperature and the tangential line showing the maximum slope between the kickoff of the peak and the top of the peak is determined. In the present invention, the latter temperature for an amorphous resin is referred to as the glass transition temperature, and the former temperature for a releasing agent is referred to as the melting point.

[Acid Value of Resin]

The acid value is determined by a method according to JIS K 0070.

[Number-Average Molecular Weight and Weight-Average Molecular Weight of Resin]

The molecular weight distribution is determined by gel permeation chromatography by the method as described below, and the number-average molecular weight and the weight-average molecular weight are calculated.

(1) Preparation of Sample Solution

A crystalline polyester is dissolved in chloroform, or an amorphous polyester is dissolved in tetrahydrofuran, so as to be a concentration of 0.5 g/100 ml. Next, the solution is filtered using a fluororesin filter having a pore size of 2 μm (FP-200, commercially available from Sumitomo Electric Industries, Ltd.), to remove insoluble components to give a sample solution.

(2) Determination of Molecular Weight Distribution

The measurement is taken by passing, as an eluent, chloroform in the case of determination for a crystalline polyester, or tetrahydrofuran in the case of determination for an amorphous polyester, at a flow rate of 1 ml per minute, stabilizing a column in a thermostat at 40° C., and injecting 100 μl of the sample solution. The molecular weight of the sample is calculated from a calibration curve previously obtained. Here, the calibration curves used is obtained using several types of monodispersed polystyrenes as a standard sample.

Apparatus for Measurement: CO-8010 (commercially available from Tosoh Corporation)

Column for Analysis: GMHLX+G3000HXL (commercially available from Tosoh Corporation)

Preparation Example 1 for Crystalline Polyester

A 5-liter four-necked flask equipped with a nitrogen inlet tube, a dehydration tube, a stirrer and a thermocouple was charged with the raw material monomers as shown in Table 1, and the ingredients were reacted at 160° C. over a period of 5 hours. Thereafter, the temperature was raised to 200° C., and the ingredients were reacted for 1 hour and further reacted at 8.3 kPa for 1 hour, to give a resin a.

Preparation Example 2 for Crystalline Polyester

A 5-liter four-necked flask equipped with a nitrogen inlet tube, a dehydration tube, a stirrer and a thermocouple was charged with the raw material monomers as shown in Table 1 or 2, and 4 g of dibutyltin oxide. The ingredients were reacted at 200° C. until no more granules of terephthalic acid or isoterephthalic acid were observed. Thereafter, the ingredients were further reacted at 8.3 kPa for 3 hours, to give each of resins b to h.

Preparation Example 3 for Crystalline Polyester

A 5-liter four-necked flask equipped with a nitrogen inlet tube, a dehydration tube, a stirrer and a thermocouple was charged with the raw material monomers as shown in Table 2, and 4 g of dibutyltin oxide. The ingredients were reacted at 8.3 kPa for 1 hour, to give a resin i.

Preparation Example 4 for Crystalline Polyester

A 5-liter four-necked flask equipped with a nitrogen inlet tube, a dehydration tube, a stirrer and a thermocouple was charged with the raw material monomers as shown in Table 2, and 4 g of dibutyltin oxide. The ingredients were reacted at 200° C. until no more granules of isoterephthalic acid were observed. Thereafter, the temperature was raised to 210° C., and the ingredients were further reacted at 2 kPa for 3 hours, to give a resin j.

The ingredients were reacted at 220° C. over a period of 8 hours, and then reacted at 8.3 kPa for 1 hour. Further, trimellitic anhydride was added at 210° C., and the ingredients were reacted until the desired softening point was attained, to give each of resins A and B.

Preparation Example 2 for Amorphous Polyester

A 5-liter four-necked flask equipped with a nitrogen inlet tube, a dehydration tube, a stirrer and a thermocouple was charged with the raw material monomers as shown in Table 3, and 4 g of dibutyltin oxide. The ingredients were reacted at 220° C. over a period of 8 hours, and then reacted at 8.3 kPa for 1 hour. Further, the ingredients were reacted at 210° C. until the desired softening point was attained, to give each of resins C and D.

TABLE 1

| Crystalline Polyester | Resin a | Resin b | Resin c | Resin d | Resin e |
|---|---|---|---|---|---|
| Alcohol Component | | | | | |
| 1,4-Butanediol | 1215 g (90) | 1350 g (100) | 1350 g (100) | 945 g (70) | 810 g (60) |
| 1,6-Hexanediol | 177 g (10) | — | — | 531 g (30) | 708 g (40) |
| Carboxylic Acid Component | | | | | |
| Fumaric Acid | 1740 g (100) | — | — | — | — |
| Terephthalic Acid | — | 2490 g (100) | 1743 g (70) | 2490 g (100) | 2490 g (100) |
| Isophthalic Acid | — | — | — | — | — |
| Adipic Acid | — | — | 648 g (30) | — | — |
| Properties of Resin | | | | | |
| Softening Point (° C.) | 122.0 | 152.1 | 124.3 | 123.9 | 104.6 |
| Temperature (° C.) of Maximum Endothermic Peak | 124.6 | 157.4 | 129.5 | 128.8 | 111.2 |
| Number-average Molecular Weight | 5200 | 4700 | 4900 | 5500 | 5100 |
| Weight-average Molecular Weight | 78500 | 62000 | 70100 | 83600 | 72200 |

Note) The amount in parentheses is expressed as molar ratio.

TABLE 2

| Crystalline Polyester | Resin f | Resin g | Resin h | Resin i | Resin j |
|---|---|---|---|---|---|
| Alcohol Component | | | | | |
| 1,4-Butanediol | 945 g (70) | 1152 g (80) | 1350 g (100) | 945 g (70) | 945 g (70) |
| 1,6-Hexanediol | 531 g (30) | 378 g (20) | — | 531 g (30) | 531 g (30) |
| Carboxylic Acid Component | | | | | |
| Fumaric Acid | — | — | — | — | — |
| Terephthalic Acid | — | 2390 g (90) | 1494 g (60) | — | — |
| Isophthalic Acid | 2490 g (100) | — | — | 2490 g (100) | 2490 g (100) |
| Adipic Acid | — | 230 g (10) | 864 g (40) | — | — |
| Properties of Resin | | | | | |
| Softening Point (° C.) | 108.9 | 106.8 | 103.5 | 106.5 | 118.3 |
| Temperature (° C.) of Maximum Endothermic Peak | 113.5 | 112.2 | 109.8 | 113.6 | 113.8 |
| Number-average Molecular Weight | 5900 | 4300 | 4500 | 2900 | 12200 |
| Weight-average Molecular Weight | 81700 | 79200 | 82400 | 12500 | 3450000 |

Note) The amount in parentheses is expressed as molar ratio.

Preparation Example 1 for Amorphous Polyester

A 5-liter four-necked flask equipped with a nitrogen inlet tube, a dehydration tube, a stirrer and a thermocouple was charged with the raw material monomers except trimellitic anhydride as shown in Table 3, and 4 g of dibutyltin oxide.

TABLE 3

| Amorphous Polyester | Resin A | Resin B | Resin C | Resin D |
|---|---|---|---|---|
| Alcohol Component | | | | |
| BPA-PO[1)] | 2310 g (82.5) | 2415 g (86.3) | 2205 g (82.4) | 2100 g (100) |
| BPA-EO[2)] | 715 g (27.5) | 748 g (28.8) | 878 g (35.3) | — |
| Carboxylic Acid Component | | | | |
| Fumaric Acid | — | 650 g (70) | — | 675 g (97) |
| Terephthalic Acid | 1129 g (85) | — | 1270 g (100) | — |
| Trimellitic Anhydride | 230 g (15) | 461 g (30) | — | — |
| Properties of Resin | | | | |
| Acid Value (mg KOH/g) | 5.6 | 19.3 | 5.5 | 25.6 |
| Softening Point (° C.) | 145.1 | 145.9 | 104.3 | 101.3 |
| Temperature (° C.) of Maximum Endothermic Peak | 67.2 | 64.4 | 63.0 | 63.2 |
| Glass Transition Temperature (° C.) | 64.4 | 61.3 | 59.6 | 59.5 |
| Number-average Molecular Weight | 2600 | 2900 | 3400 | 3100 |
| Weight-average Molecular Weight | 308000 | 240000 | 7000 | 7300 |

Note
The amount in parentheses is expressed as molar ratio.
[1)]Polyoxypropylene(2.2)-2,2-bis(4-hydroxyphenyl)propane
[2)]Polyoxyethylene(2.2)-2,2-bis(4-hydroxyphenyl)propane Preparation Example 3 for Amorphous Polyester A 5-liter four-necked flask equipped with a dehydration tube with a rectifying tower through which a hot water at 100° C. was passed, a nitrogen inlet tube, a stirrer, and a thermocouple was charged with the raw material monomers except trimellitic anhydride as shown in Table 4 or 5, and 4 g of dibutyltin oxide. The ingredients were reacted at 180° C. to 230° C. over a period of 8 hours, and then reacted at 8.3 kPa for 1 hour. Further, trimellitic anhydride was added, and the ingredients were reacted at 220° C. and 40 kPa until the desired softening point was attained, to give each of resins E to J.

TABLE 4

| Amorphous Polyester | Resin E | Resin F |
|---|---|---|
| Alcohol Component | | |
| Ethylene Glycol | 489 g (35) | 791 g (51) |

TABLE 4-continued

| Amorphous Polyester | Resin E | Resin F |
|---|---|---|
| Neopentyl Glycol | 1521 g (65) | 1275 g (49) |
| Carboxylic Acid Component | | |
| Terephthalic Acid | 3175 g (85) | 3696 g (89) |
| Trimellitic Anhydride | 432 g (10) | 240 g (5) |
| Properties of Resin | | |
| Acid Value (mg KOH/g) | 21.3 | 9.7 |
| Softening Point (° C.) | 141.3 | 102.2 |
| Temperature (° C.) of Maximum Endothermic Peak | 70.1 | 64.4 |
| Glass Transition Temperature (° C.) | 68.2 | 61.0 |
| Number-average Molecular Weight | 2700 | 1900 |
| Weight-average Molecular Weight | 192000 | 4900 |

Note
The amount in parentheses is expressed as molar ratio.

TABLE 5

| Amorphous Polyester | Resin G | Resin H | Resin I | Resin J |
|---|---|---|---|---|
| Alcohol Component | | | | |
| BPA-PO[1)] | 1470 g (70) | 1470 g (70) | 1260 g (60) | 1260 g (60) |
| Ethylene Glycol | 112 g (30) | 112 g (30) | 149 g (40) | 149 g (40) |
| Carboxylic Acid Component | | | | |
| Terephthalic Acid | 797 g (80) | 797 g (80) | 797 g (80) | 797 g (80) |
| Trimellitic Anhydride | 230 g (20) | 58 g (5) | 230 g (20) | 58 g (5) |
| Properties of Resin | | | | |
| Acid Value (mg KOH/g) | 18.5 | 11.4 | 22.3 | 9.9 |
| Softening Point (° C.) | 144.3 | 98.5 | 146.6 | 99.2 |
| Temperature (° C.) of Maximum Endothermic Peak | 64.8 | 64.6 | 63.7 | 62.1 |

TABLE 5-continued

| Amorphous Polyester | Resin G | Resin H | Resin I | Resin J |
|---|---|---|---|---|
| Glass Transition Temperature | 62.1 | 61.3 | 59.8 | 58.3 |
| Number-average Molecular Weight | 3000 | 1900 | 3200 | 2000 |
| Weight-average Molecular Weight | 165000 | 7800 | 180000 | 9900 |

Note
The amount in parentheses is expressed as molar ratio.
1)Polyoxypropylene(2.2)-2,2-bis(4-hydroxyphenyl)propane Preparation Example 1 for Amorphous Hybrid Resin A 5-liter four-necked flask equipped with a nitrogen inlet tube, a dehydration tube, a stirrer and a thermocouple was charged with the raw material monomers for a polyester, as shown in Table 6, and 4 g of dibutyltin oxide. While the ingredients were stirred under an nitrogen atmosphere at 160° C., a mixture of the raw material monomers for a vinyl resin and the polymerization initiator, as shown in Table 6, was added dropwise from a dropping funnel to the stirred ingredients over a period of 1 hour. The resulting mixture was aged during the addition polymerization reaction for 2 hours, with keeping the temperature at 160° C. Thereafter, the temperature was raised to 230° C., and the condensation polymerization reaction was allowed to proceed until the desired softening point was attained, to give each of resins K and L.

TABLE 6

| Amorphous Hybrid Resin | Resin K | Resin L |
|---|---|---|
| Raw Material Monomers for Polyester | | |
| BPA-PO1) | 1690 g (80) | 1715 g (70) |
| BPA-EO 2) | 455 g (20) | 683 g (30) |
| Terephthalic Acid | 871 g (75) | 813 g (70) |
| Trimellitic Anhydride | 269 g (20) | 269 g (20) |
| Raw Material Monomers for Vinyl Resin | | |
| Styrene | 656 g (84) | 646 g (84) |
| Butyl Acrylate | 125 g (16) | 123 g (16) |
| Acrylic Acid (Dually Reactive Monomer) | 30 g (6) | 30 g (6) |
| Polymerization Initiator | | |
| Dicumyl Peroxide | 47 g (6) | 46 g (6) |
| Properties of Resin | | |
| Acid Value (mg KOH/g) | 22.5 | 13.4 |
| Softening Point (° C.) | 146.3 | 102.3 |
| Temperature (° C.) of Maximum Endothermic Peak | 65.1 | 64.0 |
| Glass Transition Temperature (° C.) | 61.2 | 60.6 |
| Number-average Molecular Weight | 2800 | 2500 |
| Weight-average Molecular Weight | 195000 | 11700 |

Note
The amount in parentheses is expressed as molar ratio, except that the amount of polymerization initiator is expressed in parts by weight based on 100 parts by weight of all the raw material monomers for the vinyl resin.
1)Polyoxypropylene(2.2)-2,2-bis(4-hydroxyphenyl)propane
2)Polyoxyethylene(2.2)-2,2-bis(4-hydroxyphenyl)propane Examples 1 to 12 and Comparative Examples 1 to 6

One-hundred parts by weight of a resin binder as shown in Table 7, 67 parts by weight of a magnetic powder "MTS 106 HD" (commercially available from Toda Kogyo Corp.), 0.5 parts by weight of a charge control agent "T-77" (commercially available from Hodogaya Chemical Co., Ltd.), 2 parts by weight of a polyethylene wax "C-80" (commercially available from Sazol, melting point: 82° C.) and 2 parts by weight of a polypropylene wax "NP-105" (commercially available from MITSUI CHEMICALS, INC., melting point: 140° C.) were sufficiently mixed with a Henschel mixer. Thereafter, the mixture was melt-kneaded using a co-rotating twin-screw extruder having an entire length of the kneading portion of 1560 mm, a screw diameter of 42 mm and a barrel inner diameter of 43 mm. The heating temperature within the roller was 140° C., the rotational speed of the roller was 150 rpm, the feeding rate of the mixture was 20 kg/h, and the average residence time was about 18 seconds.

The resulting melt-kneaded product was rolled with a chill roll, mechanically pulverized, and classified, to give a powder having a weight-average particle size ($D_4$) of 6.5 μm.

Two parts by weight of a hydrophobic silica "R-972" (commercially available from Nippon Aerosil) and 1 part by weight of strontium titanate "ST" (commercially available from Fuji Titanium Industry Co., Ltd.) were added as external additives to 100 parts by weight of the resulting powder, and mixed with a Henschel mixer, to give a magnetic toner.

Test Example 1 [Low-Temperature Fixing Ability]

Two-hundred and fifty grams of the magnetic toner was loaded in an apparatus for magnetic monocomponent development "Laser Jet 4200" (commercially available from Hewlett Packard), and an unfixed image (2 cm×12 cm) with an amount of toner adhered of 0.6 mg/cm$^2$ was obtained.

The unfixed image obtained was subjected to a fixing test with a fixing device (fixing speed: 200 mm/sec) in a copy machine "AR-505" (commercially available from Sharp Corporation) which was modified to enable fixing of the unfixed image off-line, while sequentially raising the temperature from 100° to 240° C. in increments of 10° C. The sheets used for fixing were "CopyBond SF-70NA" (commercially available from Sharp Corporation, 75 g/m$^2$).

A "UNICEF Cellophane" (commercially available from MITSUBISHI PENCIL CO., LTD., width: 18 mm, JIS Z-1522) was adhered to each of the images fixed at each temperature, and passed through a fixing roller set at 30° C. in the above fixing device, and thereafter the tape was stripped away. The optical reflective density of the image after strip-away of the tape was measured using a reflective densitometer "RD-915" (commercially available from Macbeth Process Measurements Co.). The optical reflective density of the image before adhesion of the tape was also measured previously. The temperature of the fixing roller at which the ratio of the optical densities (after strip-away of the tape/before adhesion of the tape) initially exceeds 90% is defined as the lowest fixing temperature. The low-temperature fixing ability was evaluated according to the following evaluation criteria. The results are shown in Table 7.

[Evaluation Criteria]

◎: Lowest fixing temperature being lower than 160° C.;

○: Lowest fixing temperature being 160° or higher and lower than 180° C.;

Δ: Lowest fixing temperature being 180° or higher and lower than 200° C.; and x: Lowest fixing temperature being 200° C. or higher.

Test Example 2 [Environmental Stability]

Two set of 20-ml plastic containers containing 0.4 g of the toner and 9.6 g of a silicone-coated ferrite carrier having an average particle size of 90 μm (commercially available from Kanto Denka Kogyo Co., Ltd.) were prepared. With the tops of the containers opened, one was left under a normal-temperature, normal-humidity (NN) environment at a temperature of 25° C. and a relative humidity of 50% for 24 hours, while the other was left under a high-temperature, high-humidity (HH) environment at a temperature of 35° C. and a relative humidity of 80% for 24 hours. After that, the toner and the carrier were mixed in a ball-mill for 10 minutes under each environment, and the triboelectric charges were determined using a "q/m Meter MODEL 210HS" (commercially available from TREK). The ratio (HH/NN) of the triboelectric charges (μC/g) under the HH environment to the triboelectric charges (μC/g) under the NN environment was calculated, and the environmental stability was evaluated according to the following evaluation criteria. The results are shown in Table 7.

[Evaluation Criteria]

◎: HH/NN being 0.8 or more;

○: HH/NN being 0.6 or more and less than 0.8; and x: HH/NN being less than 0.6.

Test Example 3 [Blocking Resistance]

Ten grams of the toner was put in a container having a cross sectional area of 9.1 $cm^2$, and a 200-g weight was placed on the toner and left under an environment at a temperature of 40° C. and a relative humidity of 60% for 5 days. After that, the toner was sieved through a 500-mesh sieve (sieve opening: 25 μm), and the blocking resistance was evaluated according to the following evaluation criteria. The results are shown in Table 7.

[Evaluation Criteria]

◎: Amount of the toner remained on the sieve being less than 0.1 g;

Δ: Amount of the toner remained on the sieve being 0.1 g or more and less than 1.0 g; and x: Amount of the toner remained on the sieve being 1.0 g or more.

TABLE 7

| | Resin Binder [1)] | | | Low-Temperature | Environ- | |
|---|---|---|---|---|---|---|
| | Crystalline Polyester | Amorphous Polyester-based Resin | | Fixing Ability | mental Stability | Blocking Resistance |
| Ex. 1 | Resin f/20 | Resin A/40 | Resin C/40 | ◎ | ○ | ◎ |
| Ex. 2 | Resin f/20 | Resin B/40 | Resin D/40 | ◎ | ○ | ◎ |
| Ex. 3 | Resin f/20 | Resin G/40 | Resin H/40 | ◎ | ○ | ○ |
| Comp. Ex.1 | Resin f/20 | Resin I/40 | Resin J/40 | ◎ | X | X |
| Comp. Ex.2 | Resin f/20 | Resin E/40 | Resin F/40 | ◎ | X | X |
| Ex. 4 | Resin f/20 | Resin K/40 | Resin L/40 | ◎ | ◎ | ◎ |
| Ex. 5 | Resin g/20 | Resin K/40 | Resin L/40 | ◎ | ◎ | ◎ |
| Ex. 6 | Resin e/20 | Resin K/40 | Resin L/40 | ◎ | ○ | ◎ |
| Ex. 7 | Resin d/20 | Resin K/40 | Resin L/40 | ○ | ◎ | ◎ |
| Ex. 8 | Resin c/20 | Resin K/40 | Resin L/40 | ○ | ○ | ◎ |
| Ex. 9 | Resin i/20 | Resin K/40 | Resin L/40 | ◎ | ◎ | ○ |
| Ex. 10 | Resin j/20 | Resin K/40 | Resin L/40 | ○ | ◎ | ◎ |
| Ex. 11 | Resin f/10 | Resin K/50 | Resin L/40 | ○ | ◎ | ◎ |
| Ex. 12 | Resin f/40 | Resin K/30 | Resin L/30 | ◎ | ◎ | ○ |
| Comp. Ex.3 | Resin b/20 | Resin K/40 | Resin L/40 | X | ◎ | ◎ |
| Comp. Ex.4 | Resin a/20 | Resin K/40 | Resin L/40 | Δ | X | ○ |
| Comp. Ex.5 | Resin h/20 | Resin K/40 | Resin L/40 | ◎ | X | ○ |
| Comp. Ex.6 | Resin f/60 | Resin K/20 | Resin L/20 | ◎ | ○ | X |

[1)] The figures represent the parts by weight of the resin used in the resin binder.

It can be seen from the above results that the toners of Examples have excellent properties for practical use in all of the low-temperature fixing ability, environmental stability and blocking resistance, as compared to the toners of Comparative Examples.

On the other hand, the toners of Comparative Examples 1 and 2 are poor in environmental stability and blocking resistance since the amount of the alkylene oxide adduct of bisphenol A used in the amorphous polyester-based resin is smaller than the amounts as specified in the present invention. Also, the toner of Comparative Example 3 is poor in low-temperature fixing ability since the softening point of the crystalline polyester is too high, and the toners of Comparative Examples 4 and 5 are poor in environmental stability since the amount of the aromatic dicarboxylic acid compound used in the crystalline polyester is smaller than the amounts as specified in the present invention. The toner of Comparative Example 6 is poor in blocking resistance since the amount of the crystalline polyester is too large.

The resin binder for toner of the present invention is used as a resin binder for a toner used, for instance, for developing electrostatic latent images formed in electrophotography, electrostatic recording method, electrostatic printing method, and the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A resin binder for toner, comprising:

a crystalline polyester having a softening point of 80° to 130° C., comprising a resin obtained by polycondensation of an alcohol component comprising 70% by mol or more of an aliphatic diol having 2 to 8 carbon atoms, and a carboxylic acid component comprising 70% by mol or more of an aromatic dicarboxylic acid compound; and an amorphous polyester-based resin, comprising a resin comprising a polyester component obtained by polycondensation of an alcohol component comprising 70% by mol or more of an alkylene oxide adduct of bisphenol A, represented by the formula (I):

(I)

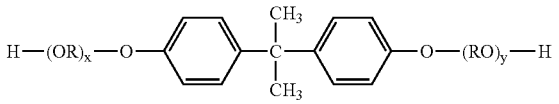

wherein R is an alkylene group having 2 or 3 carbon atoms; x and y are a positive number;

and the sum of x and y is from 1 to 16, and a carboxylic acid component, wherein the weight ratio of the crystalline polyester to the amorphous polyester-based resin is from 5/95 to 50/50, and wherein the crystalline polyester has a number-average molecular weight of from 2000 to 10000, and a weight-average molecular weight of from 60000 to 1000000.

2. The resin binder according to claim 1, wherein the aliphatic diol having 2 to 8 carbon atoms is 1,4-butanediol and/or 1,6-hexanediol.

3. The resin binder according to claim 1, wherein the aromatic dicarboxylic acid compound is at least one member selected from the group consisting of phthalic acid, isophthalic acid, terephthalic acid, and acid anhydrides thereof.

4. The resin binder according to claim 1, wherein the carboxylic acid component for the amorphous polyester-based resin comprises 70% by mol or more of an aromatic dicarboxylic acid compound.

5. The resin binder according to claim 1, wherein the amorphous polyester-based resin is a polyester and/or a hybrid resin comprising a polyester component and a vinyl resin component.

6. The resin binder according to claim 1, wherein the amorphous polyester-based resin has a number-average molecular weight of from 1000 to 6000, and a weight-average molecular weight of from 10000 to 1000000.

7. The resin binder according to claim 1, wherein the amorphous polyester-based resin comprises two different kinds of resins of which softening points differ by 10° C. or more, wherein the lower-softening point resin has a softening point of from 80° to 120° C., and the higher-softening point resin has a softening point of from 120° to 160° C.

8. A toner comprising the resin binder as defined in claim 1.

9. The toner according to claim 8, wherein the toner is a toner for magnetic monocomponent development, the toner further comprising a magnetic powder in an amount of 30% by weight or more of the toner.

10. The resin binder according to claim 1, wherein the carboxylic acid component comprises 75% by mol or more of the aromatic dicarboxylic acid compound.

11. The resin binder according to claim 1, wherein the carboxylic acid component comprises from 80 to 100% by mol of the aromatic dicarboxylic acid.

12. The resin binder according to claim 1, wherein the carboxylic acid component is 100% by mol of the aromatic dicarboxylic acid.

13. The resin binder according to claim 1, wherein the crystalline polyester has a number-average molecular weight of from 4,000 to 8,000.

14. The resin binder according to claim 1, wherein the crystalline polyester has a softening point of from 90 to 115° C.

15. The resin binder according to claim 1, wherein the carboxylic acid component comprises 100% by mol of terephthalic acid.

16. The resin binder according to claim 1, wherein the carboxylic acid component comprises terephthalic acid and adipic acid.

17. The resin binder according to claim 16, wherein the alcohol component is 1,4-butanediol.

18. The resin binder according to claim 1, wherein the alcohol component is at least one selected from the group consisting of 1,4-butanediol and 1,6-hexanediol, and the carboxylic acid component is at least one selected from the group consisting of fumaric acid, terephthalic acid, isophthalic acid, and adipic acid.

* * * * *